United States Patent [19]

Bowman

[11] Patent Number: 4,872,780

[45] Date of Patent: Oct. 10, 1989

[54] MANHOLE COVER SUPPORT WITH BOX FLANGING

[76] Inventor: Harold M. Bowman, 18867 N. Vallley Dr., Fairview Park, Ohio 44126

[21] Appl. No.: 207,185

[22] Filed: Jun. 15, 1988

Related U.S. Application Data

[63] Continuation-in-part of Ser. No. 76,668, Jul. 23, 1987, and Ser. No. 20,573, Jun. 1, 1988.

[51] Int. Cl.[4] ..... E02D 29/14

[52] U.S. Cl. ..... 404/26; 52/20

[58] Field of Search ..... 404/25, 26; 52/19, 20, 52/21; 49/41, 466, 505; 210/166

[56] References Cited

U.S. PATENT DOCUMENTS

| | | | |
|---|---|---|---|
| 1,908,909 | 5/1933 | Manz | 52/19 |
| 2,109,287 | 2/1938 | Elkington | 404/25 |
| 3,773,428 | 11/1973 | Bowman | 404/26 |
| 3,891,337 | 6/1975 | McCoy | 404/26 |
| 4,440,407 | 4/1984 | Gagas | 277/207 A X |

*Primary Examiner*—Jerome W. Massie, IV
*Assistant Examiner*—Matthew Smith
*Attorney, Agent, or Firm*—Watts, Hoffmann, Fisher & Heinke Co.

[57] ABSTRACT

An improved manhole cover support adapted to raise the effective grade of an existing manhole cover receiving structure such as a manhole cover frame is shown. Integral with and substantially coextensive with the top of its thin-walled cover keeper portion is a stiffening wale that defines a cavity. The cavity can be, for example, rectangular or arcuate, and it can contain a cohesive or other filler solid. The cover support need not be adjustable in perimeter, and wale need not be continuous but interrupted adjacent ends can be joined. The cover support can have water seals of compressible polymer that are interposed between its cover seat and the cover that it is to accept, and between its outer perimeter and the upper surface, e.g., paving, into which it is set and/or the shoulder of the existing manhole cover receiving structure where it sits. At least part of the sealing elements can be adherent to the cover support.

32 Claims, 5 Drawing Sheets

MANHOLE COVER SUPPORT WITH BOX FLANGING

REFERENCE TO OTHER APPLICATIONS

This patent application is a continuation-in-part of the applicant's co-pending U.S. patent application Ser. No. 076,668 filed on July 23, 1987, entitled *Utility Cover Extension* and the co-pending one Ser. No. 201,573 filed on June 1, 1988, entitled *Polygonal Manhole Cover Support.* It also is referenced to the following related co-pending U.S. patent applications, all filed on even date, June 15, 1988, herewith: *Manhole Cover Support Having Enhanced Grip,* Ser. No. 207,326; *Manhole Cover Support Resistant to Water Infiltration,* Ser. No. 207,325; and *Sturdy Adjustable Manhole Cover Support,* Ser. No. 207,266. The teachings of those applications are incorporated herein by reference.

BACKGROUND OF THE INVENTION

This invention relates to adjustable manhole cover supports for emplacing over and raising the grade of an existing manhole cover receiving structure.

For simplicity the terms "existing manhole cover receiving structure" and "manhole cover" herein are used to refer to the existing, i.e., fixed in-place frame or other existing seating receptacle for a removable cover or grating that covers an access hole (i.e., hand hole, tool hole, manhole, catch basin or the like), and that cover or grating ordinarily is intended to bear vehicular traffic. The term "manhole cover support" or simply "cover support" here means a structure that fits over the existing manhole cover receiving structure, raises its grade, and thereby accommodates a cover or grating at the new grade. Advantageously, the cover or grating is the same one that was used at the lower grade. The access hole covered is a utility enclosure serving, e.g., an electric, gas, water, sewer or storm drainage system.

Ordinarily the instant cover support finds its use when a roadway such as a street or highway is resurfaced with an added layer of paving material. Typically asphalt concrete, or otherwise is overlaid or repaved to establish a higher grade. It then is advantageous to mount the inventive cover support atop the existing manhole receiving structure. Prior art on manhole cover supports and manhole cover frames can be found in U.S. Pat. Nos. 4,281,944, 4,236,358, 3,968,600, 3,773,428, 4,097,171, 4,302,126, 3,891,337 and 1,987,502. The first four of these are for inventions of the applicant.

Axle loads up to 40,000 pounds must be resisted by many of these cover supports as well as serious impact loads from vehicles and snow plows, a variety of temperature effects, steam leaks, spillage, etc., without permitting a hazardous dislocation of the cover support or its cover. Often it is desirable also to cushion the cover a bit for resisting wear or reducing noise, or to seal the cover and its cover support against a substantial and possibly overloading infiltration of surface water, e.g., storm drainage that otherwise would enter a sanitary sewer system at various manhole locations. Adjustability of the cover support in peripheral dimension and height also is important for accommodating the wide range of specifications to be met.

Installing, adjusting, loading and unloading and otherwise handling manhole cover supports and removing the covers therefrom usually is done with powerful and indelicate tools such as picks, pinch bars, crowbars, tongs, heavy hooks and the like. Deformation of the cover support can occur, particularly about its upper edge which is nearest the road surface. Also, the upper edge usually is the handiest area for applying lifting and other tools. Deformations of the edge never are good, and they can render the opening of the support unfit for service. Hence, overall ruggedness and stiffness against deformation, especially at or near the top rim, and resistance to displacement are major concerns about manhole cover supports.

On the other hand, a relatively light construction of the cover support, in comparison to the ponderous cast iron frame that usually initially supports the manhole cover when the first paving is laid, can be very desirable, provided, however, that an inordinate amount of the ruggedness, stiffness, and resistance to displacement or dislodgement is not sacrificed. Usually a main place for weight reduction is in the lateral keeper for the cover. Another place is in the base of the cover support. Clearly, the economics of manufacture, handling and installation all are generally in favor of lower weight. A relatively thin wall keeper would normally be of steel, with the wall rarely no more than about 0.1 inch (12 ga.) thick, usually less.

The instant cover support permits the combining of a reasonably low overall weight with a very high degree of stiffness. Additionally, the inventive cover support can be adapted readily to be sealed off against water infiltration and to cushion the cover. It can be made adjustable in outer perimeter if desired.

No previously proposed manhole cover support known to the inventor combines such stiffness with light to moderate weight, while also permitting one or more of the other desirable options noted above.

BROAD STATEMENT OF THE INVENTION

The present invention relates to a manhole cover support for emplacing into and raising the effective grade of an existing manhole cover receiving structure that has a shoulder with a top (which usually was at or near the original grade of the original paving). The cover support comprises a base, a seat, and a relatively thin-walled keeper for the manhole cover. The outer wall of the base faces the inner shoulder surface, and the keeper projects upwardly from the seat. The cover support is characterized by a hollow stiffening wale that is integral with and substantially coextensive with the top of the keeper. It is disposed to clear the top of the shoulder of the receiving structure.

Figure 1:
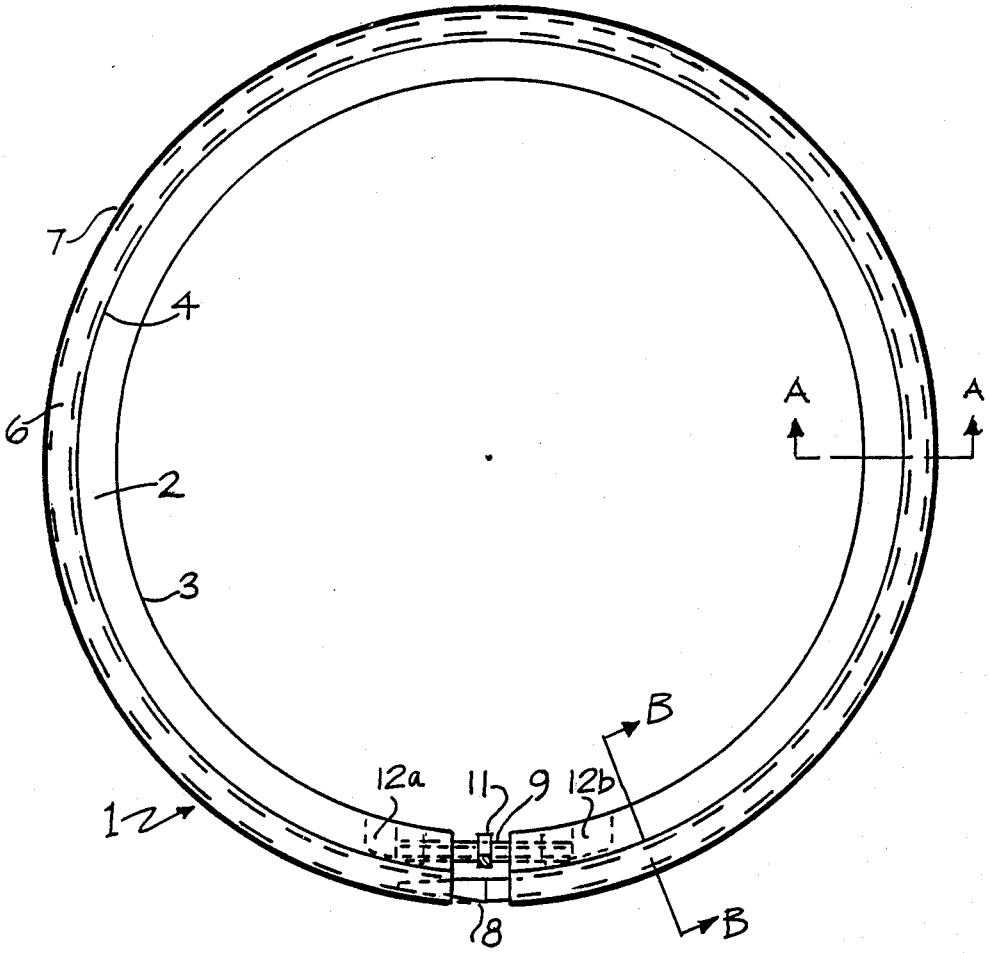
FIGS. 1–9 illustrate adjustable cover supports with practically vertically rising cover keeper walls. Such keepers necessarily must be thin-waled to fit into an existing frame and still accommodate the origninal cover. In other words, that cover must lie flat on the new seat that is bounded by the walls of such keeper. While the present cover support does not have to be adjustable as to its outer perimeter dimensions, it can be made so adjustable, if desired.

As one should have no difficulty in forming a mental picture of the drawing figures devoid of their joints, turnbuckles, etc. to have simply a continuous, uninterrupted base, seat, keeper and wale, no manhole cover supports that are unadjustable as to their outer perimeter are depicted. Conventional means for locking down the support to an existing manhole cover flange, as is shown in U.S. Pat. No. 3,773,428 or the means shown in the copending parent application, Ser. No. 201,573, are usable in connection with the adjustable or unadjustable cover supports of this invention.

Figure 4:
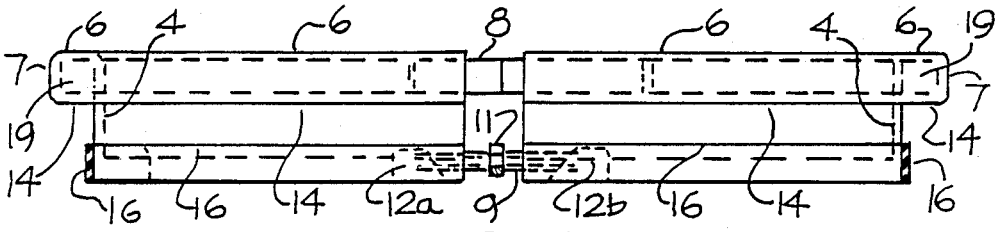
Figure 2:
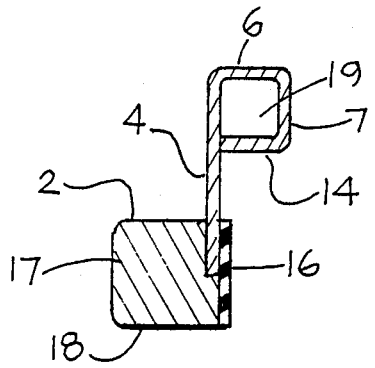
Figure 3:
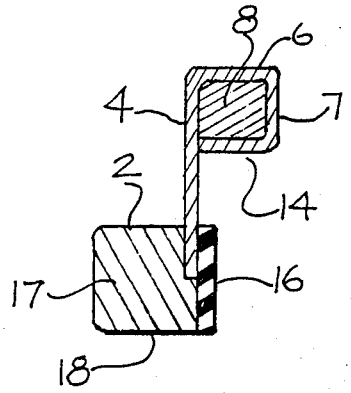
Figure 5:
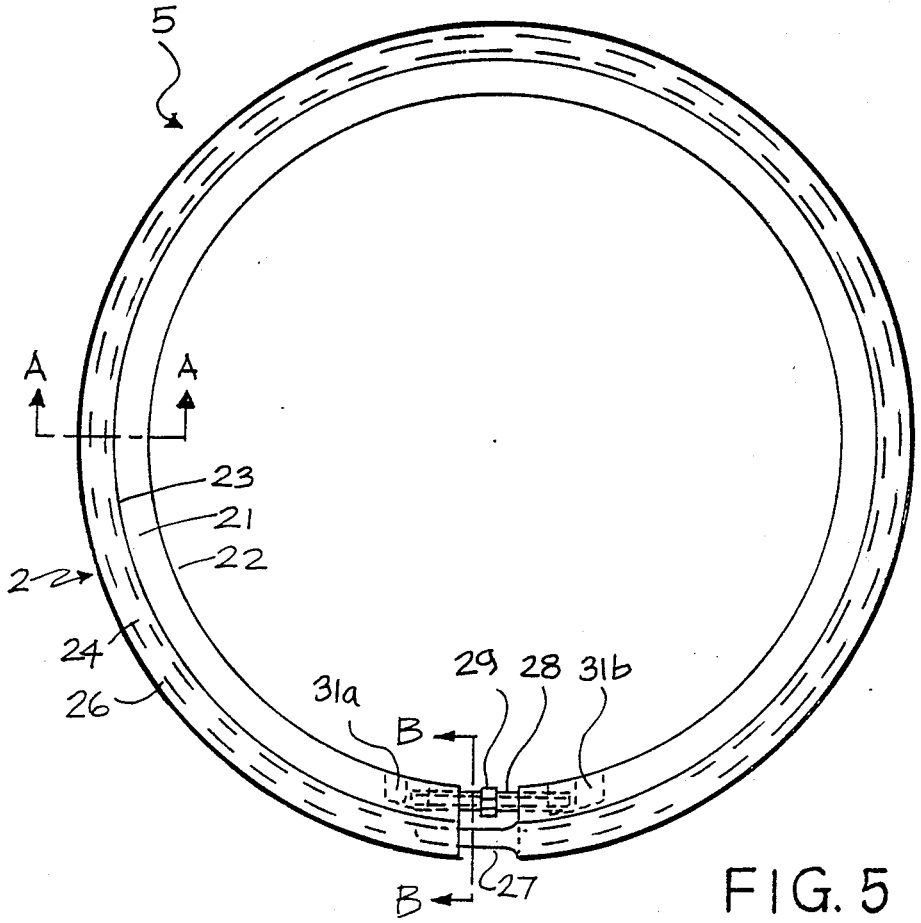
Figure 8:
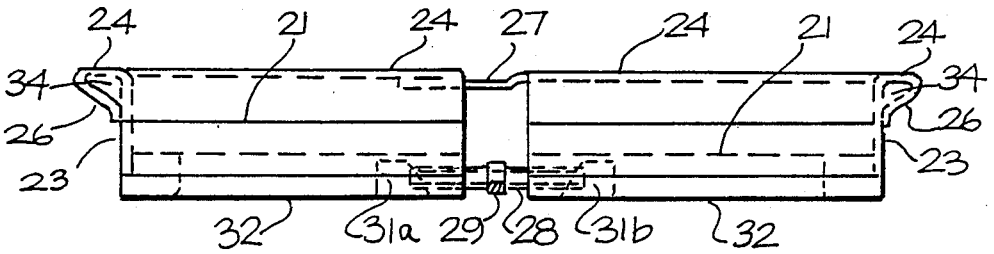
Figure 6:
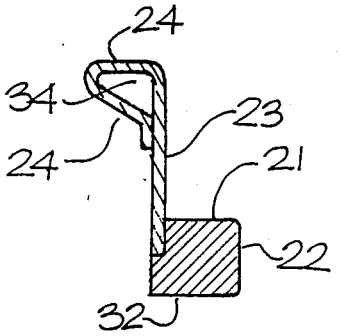
Figure 7:
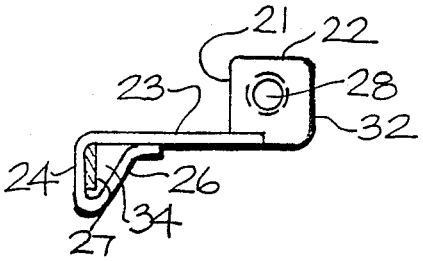
Figure 9:
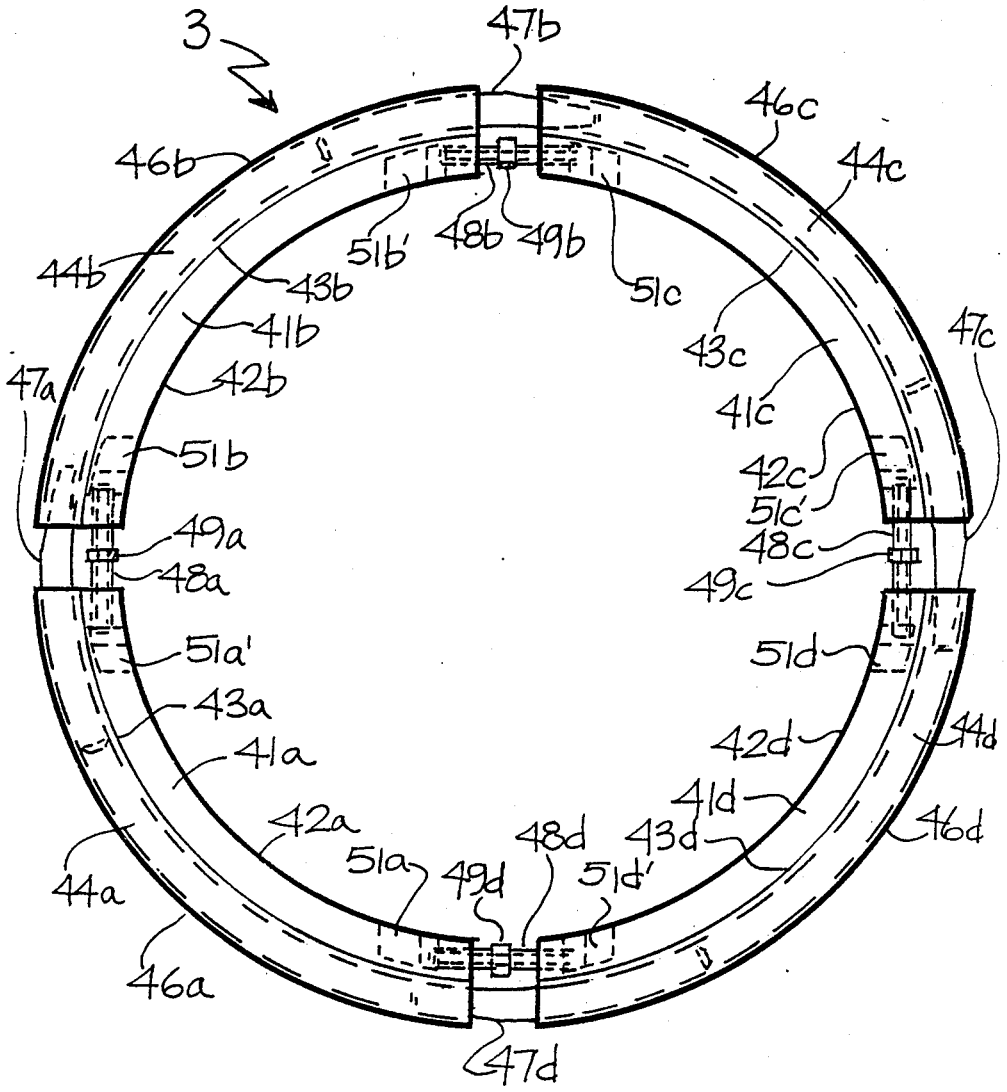
Figure 10:
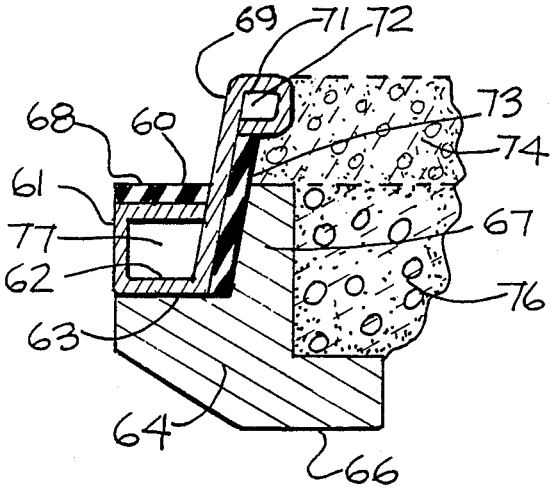

FIG. 1 is a top plan view of a preferred split-ring embodiment of the instant cover support adapted to fit a circular manhole and having a bonded-on retention component;

FIG. 2 is a vertical cross section of FIG. 1 taken through Section A—A;

FIG. 3 is a vertical cross section of FIG. 1 taken through Section B—B;

FIG. 4 is a side elevation view of the cover support of FIG. 1;

FIG. 5 is a top plan view of an all-metal split ring embodiment of the instant cover support also adapted to fit a circular manhole. The joint is bridged by an extension of the wale;

FIG. 6 is a vertical cross section of FIG. 5 taken through Section A—A;

FIG. 7 is a vertical cross section of FIG. 5 taken through Section B—B;

FIG. 8 is a side elevation view of the cover support of FIG. 5;

FIG. 9 is a top plan view of a preferred four-segmented embodiment of the instant cover support with the joints bridged by rods. This model can develop a superior frictional grip against the shoulder of an existing manhole receiving structure; and FIG. 10 is a vertical cross section of a circular cover support having no joints for perimeter adjustment. Its all-steel body can be formed from a single strip steel, bent to make a ring, and the ends welded together. Surfaces are smoothed for applying sealing members. Sealing is simpler without joints.

BEST MODES FOR CARRYING OUT THE INVENTION

Reference is made to FIG. 1. The cover support broadly is indicated by arrow 1. Seat 2 for the cover is the top of the cast ductile iron (type 536) base of this cover support. Its inner vertical wall, item 3, is one inch in height. Welded to and rising up from the outside top edge of the base is a lateral keeper 4 for the cover. The top 6 of the keeper is formed into a hollow ($\frac{3}{4}'' \times \frac{3}{4}''$ inside dimensions) wale having outside wall 7. The keeper metal is 13 gauge (0.09375″) steel.

The base and keeper, including the wale, form an almost complete circular pattern which is interrupted only by a joint that is connected with the turnbuckle bolt 9 and is bridged with tapered steel shaft 8. The bolt 9 is of A.1.S.1 type 302 stainless steel.

The right end of the shaft is of essentially square cross section, and it makes a snug fit into, and is welded into, the holow channel part of the wale. The left end of the shaft 8 is somewhat tapered, and it makes a slidable fit into the other end of the hollow channel part of the wale. Thus, the entire wale can be considered to be the box flanging around the upper periphery of the keeper and the shaft 8 across the joint.

The ends of turnbuckle bolt 9 are threaded with opposite handedness to open up the gap of the joint when turned one way, and to close the gap when turned the other way with a wrench acting on wrench grip 11. For security in service, a nylon locking patch is applied to the bolt threads. The bolt 9 runs into horizontal bolt holes in the base. The holes are tapped appropriately for bolt adjustment and extend to reach the notches **12*a* and 12*b*. The notches accept the protruding ends of bolt 9** when the gap is shortened.

If a greater amount of peripheral adjustment and greater frictional grip of the base into a manhole frame or the like is desired, a pair or two pairs (or more) of diametrically opposed joints of the type connected by bolt 9 can be used in the cover support. Thus, the cover support will be made of two or four (or more) segments, usually of equal size if the cover is circular. However, if the cover support is rectangular or otherwise polygonal or oval in plan, the joints can be at corners or on the sides; the resulting connected segments, while usually making a generally symmetrical whole in plan, will not necessarily be of equal size.

The elements of the cross section shown in FIG. 2 include those with the same numbers as used in FIG. 1 plus these: 17, the cast ductile iron base; 19, the hollow channel of the wale; 14, the bottom of the wale which can be tack-welded along the outside of keeper 4; seat 2 for the cover; bottom 18 of the base which is to rest on the existing manhole cover receiving element; and a frictional retention member 16 which is about an eighth inch thick of slightly foamed elastomer bonded to the base all around its outer perimeter. Sheet steel keeper 4 is welded to base 17 and any lumps, spatter, etc. are removed, e.g., ground off, the outer and inner seams that it makes with the base.

The element of FIG. 3 are the same as those of FIG. 2 except that the wale at this zone includes shaft 8 as an integral (e.g., welded-in) part.

The elements of FIG. 4 that also are shown in FIGS. 1, 2 and 3 have the same numbers as in those figures. Thus, item 16 is the retention component, 8 the shaft and 19 the hollow channel of the wale, 9 the turnbuckle bolt, 17 the wrench grip of the bolt, and **12*a* and 12*b*** the left and right notches, respectively, for permitting protrusion thereinto of the bolt ends. Optionally, if the retention component is not expected also to help seal out water as at least part of a seal element, can be made in the form of a plurality of incomplete lines, stripes or spots bonded to the surface instead of being in a sheet or film conformation. If desired also, the retention component can be a separate strip or strips of polymer interposed between the base and the existing manhole cover receiving structure. Furthermore, it can be in the form of one or more bands or O-rings surrounding and elastically gripping the base, e.g., in grooves therein.

The cover support embodiment shown in FIGS. 1, 2, 3 and 4 has a good frictional grip to an existing manhole cover frame. This is because the coefficient of static friction between the surface of deformable polymers, including many foamed elastomers, and metal surfaces can be much greater than that between two metal surfaces. Thus, the coefficient of static friction for the contact of a desirable polymer to a metal should be at least about 0.4, and generally it can be as high as 0.6–0.7 or higher. In a steel-to-steel instance it is unlikely to be as high as 0.35. Shore A Durometer hardness of the polymer composition preferably is at least about 20, and preferably is about 50–70. Usually, the thickness of a retention component will be between about 0.4 and 400 mils. Oil resistance can be desirable for it and the other water-sealing elements in some installations.

The coefficient of static friction is the ratio of the maximum force parallel to the surface of contact which acts to prevent motion between two bodies at rest in contact with each other from sliding over each other, to the force normal to the surface of contact which presses the bodies together. Thus, the turnbuckle spreaders at joints supply a large measure of pressure, and the bonded elastomer heightens friction, thereby making a cover support that is unusually effective for resisting dislodgement or tilting in highway service. Means for locking down the cover support to an existing manhole cover flange, e.g., like the means shown in U.S. Pat. No. 3,773,428, often are desirable in addition to simply a frictional grip, and often can be imperative for cover supports of fixed perimeter or for some rectangular or square ones of adjustable perimeter.

The cover support of FIG. 5 broadly is indicated by arrow 5. This cover support differs from that of FIG. 1 mainly in the following particulars: it has no retention component; the channel of the encircling wale has a different cross section; and a top extension 27 of the wale is bent where it projects from the channel to fit slidably into the other end of the channel and bridge the joint gap. Thus, 21 is the seat for the cover, 22 the inside wall of the base, 23 the keeper for the cover, 24 the top of the wale, 26 the outside periphery of the wale, 27 the top extension or tang of the wale, 28 the turnbuckle bolt, 29 its wrench grip, and 31*a* and 31*b* the notches for permitting protrusion of the bolt ends thereinto.

FIG. 6 shows additionally the channel 34 and the bottom 32 of the base of the cover support of FIG. 5. The joint made by wale portion 26 and keeper 23 is spot-welded.

FIG. 7 shows still further the cross section of tang 27 and bolt 28 of the cover support of FIG. 5.

The elements of FIG. 8 that also are shown in FIGS. 5, 6 and 7 have the same numbers as in those figures. Thus, item 21 is the seat, 27 the tang, 24 the top, 26 the side, and 34 the channel of the wale, 23 the keeper, 32 the bottom of the base, 28 the turnbuckle bolt, 29 its wrench grip, and 31 and 32 the notches for permitting protrusion of the bolt ends thereinto.

In FIG. 9 the body of a manhole cover support is in four like segments and is referred to broadly by arrow 3. Its metal body differs from that of FIG. 1 mainly in that respect, the cover support of FIG. 1 being simply a split ring. The multi-segmented cover support of FIG. 9 is capable of greater adjustment and a much greater frictional grip to the shoulder of an existing manhole frame than is a corresponding split ring cover support. For simplicity, the cover support of FIG. 9 is depicted without interposed retention component and sealing elements (like item 16 of FIGS. 2, 3 and 4). However, that component could be applied to each segment shown in FIG. 9 in the same way as it was to the embodiment earlier illustrated in those figures. Use of such component with the four-segmented support can further increase its frictional retention grip.

In FIG. 9 cover seat portions are 41*a, b, c* and *d;* inner wall portions of the cast ductile iron base are 42*a, b, c* and *d;* the rising 13-gauge steel keeper portions are 43*a, b, c* and *d;* the turnbuckle bolts are 48*a, b, c* and *d;* their wrench grips are 49*a, b, c* and *d;* the top of the keeper portion is a box flange portion having top portions 44*a, b, c* and *d* and side portions 46*a, b, c* and *d;* shafts 47*a, b, c* and *d* connect the channels of the opposing box flange portion ends and bridge the four joint gaps; and notches 51*a, a', b, b', c, c', d* and *d'* are disposed to permit protrusion thereinto of the ends of bolts 48*a, b, c* and *d.* The tapered ends of the shafts fit slidably into the channel portions of the box flange portions and their other ends are welded into the channel portions. Because of the remaining similarities between the metal bodies of FIGS. 1 and 9, additional views of the embodiment of FIG. 9 are not needed to understand the embodiment clearly.

The cover support of FIG. 10 shows a cross-sectional elevation taken through a circular manhole cover support (having no adjustment of its perimeter) set into an existing manhole cover frame in a street that has been resurfaced. No lockdown means are shown as these can be provided for conventionally to have the cover support grip the frame on which it rests.

Hollow channel 77 is formed by the base of the cover support, said base having top 60, inner wall 61, and bottom 62. The rising part 69 of the keeper terminates in wale 71 having channel 72. The seat and/or water seal for the cover is the bonded layer 68 of slightly foamed, cured elastomeric plastisol like that shown in connection with FIGS. 2, 3 and 4.

The bottom 62 of the base rests on the sill 63 of circular cast iron manhole cover frame 64 that also has flange 66, and shoulder 67. The elevation of the base can be raised with shims, spacers, gaskets or bolts that screw into and out of reenforced spots in the channel, all of these expedients not shown.

The top layer of asphalt concrete paving 74 rests on older portland cement concrete paving layer 76. On the outside wall of the base and keeper and bonded thereto is about ¼" thick continuous water seal layer 73 of the same material as seal 68. The lower part of that outer seal presses against the shoulder 67 of frame 64. The upper part of that outer seal and the outside of the wale abut asphaltic layer 74. The steel bodyis 13 gauge strip stock; the seams made by the top of the base and the bottom of the wale with the keeper wall is welded. It should be noted that bottom of the wale must be at least just above the top of the shoulder 67 on frame 64 to have the bottom 62 of the base of the cover support rest on sill 63 of frame 64 if the wale is to project beyond the inner surface of that shoulder. In other words, the wale must clear the top of the shoulder for the cover support to sit well in frame 64.

If the gaps made by adjustable joints of the cover support are plugged with deformable polymer, e.g., an elastomer and especially foamed elastomer, so that complete water seals result under the manhole cover and all around either the outer perimeter of the cover support base or its cover keeper rising there around, or both, then the cover support can be used to resist stray surface water such as storm drainage.

Suitable sealing plug fitments to be used with the cover support, as it is being installed, can be made of polymer or with a core or armature, e.g., one of metal, coated with polymer. Alternatively, the plug can be effected after the cover support is installed by stuffing in or spraying in a sealant, preferably a foaming or foamable-in-place one.

Hollow, peripheral encircling wales portions and hollow base portions can be filled or partly filled with a hard or tough resin, optionally mixed with a mineral filler such as mica, glass flake or chopped glass fiber strand, to supply some desirable further resistance to crushing and other deformation. Thermosetting resins, such as polyester and epoxy resins, can be useful in this connection. Also, thermoplastic ones such as ABS resin can be so used, or a rubber or a concrete such as a Gunnite type, i.e., a settable material, or a loose one such as sand can be used there.

The cross section of the hollow sleeves and wales may be square or rectangular. They can be made with many other fairly rigid conformations, e.g., triangular, rounded, etc. This also applies to the cross section of solid or tubular base-forming members. Any joint-bridging rod or tube elements need only to fit into the wale channel, to fill it or not as is needed or desired.

While the cover support embodiments depicted are for circular holes, other shapes such as rectangles, triangles, squares, ovals, etc. are usable in accordance with invention principles. If they are to be rendered adjustable as to their perimeter, turnbuckle means are used at the joints.

Reference is made again to FIGS. 2, 3 and 4 which display the bonded polymer retention component 16, and to FIG. 9, which shows a four-segmented circular manhole cover support. In tests on related circular four-segmented manhole cover supports also joined with turnbuckle bolts and having the same kind of adhering foamed elastomer retention component, (a heat-cured vinyl plastisol retention component) the following interesting fact was revealed: pulling directly upward on the expansible cover support that was held in a ring of steel by only the friction between its elastomer-coated periphery and the ring and its own weight (which was only an inconsequential minute percentage of the whole load to be pulled) took much greater force to remove than a like cover support held the same way in the ring with the same hoop stress exerted, but having no such retention member interposed. *The force factor was about* 1.38 *times as much for the coated support as for the uncoated one.*

Suitable polymers that can be formulated for use in the compressible retention component and water seals herein include natural and synthetic rubbers, water resistanct ionomers, various vinyl polymers and copolymers such as polyvinyl acetate-polyethylene-acrylate copolymers and polyvinyl chloride homopolymers, polyurethanes, polyesters resins, epoxy resins, styrene-containing copolymers such as ABS and butadiene-or isoprene-styrene copolymers, polyolefins and copolymers containing olefin units, and aminoplasts. Plasticizers, pigmentation, stains and/or mineral fillers such as talc, carbon black, etc. commonly are employed in their recipes. The best retention components appear to be elastomeric. Many of them can be foamed and preferably are foamed only very slightly; this can soften them a bit, and it makes them slightly less dense than without the foaming. Latent foaming agents reactive upon warming and/or catalyzing a film of an uncured polymer-providing material coated on a cover support are preferred. Curing with heat, ultraviolet or electron beam radiation and/or catalysis can be practiced.

Customarily, it is of advantage to prime the metal with a bonding agent or use a bonding treatment to secure the best bond of the retention component or a water sealing element to metal. Some polymers can bond well without this, e.g., epoxy resins. However, the bonds of most are improved by such priming and/or treating.

A preferred foamed plastisol formulation for the retention component is of Shore A Durometer hardness about 20–70, and preferably about 50–65, as are the water seals. The plastisol is compounded principally from low molecular weight polyvinyl chloride resin plasticized heavily with a conventional phthalate ester plasticizer. It contains minute percentages of stabilizer, red pigment and ozodicarbonamide blowing agent. Another preferred formulation of about the same Shore A Durometer hardness is a flexible polyol-polyurethane foam, slightly elastomeric and rubber. Some polymer recipes need heat to cure and foam, even with catalysis, and others cure and even foam at about room temperature (78° F.). The degree of foaming in both these plastisol and urethane formulations is very small, and it could be called almost microscopic and slight—the bubbles are closed-cell and tiny. In some case, especially where sealing is to be maximized and strength considerations are secondary, a fair amount of foaming and a resulting softened and less dense foamy structure can be tolerated, e.g., Shore A Durometer hardness of 20–55.

The preferred foamed plastisol usually is sprayed on the area to be coated. It is advantageous to spray it onto the hot metal cover support body (370°–380° F.) and let it cure and foam a bit. If extra foaming and/or curing is desired, the coated part can be further warmed at 380°–400° F. for up to a few minutes.

Metal surfaces should be cleaned to accept the polymeric material if it is to be bonded. Then a customary bonding agent such as Chemlok #218 (Manufactured by Lord Corporation, Erie, Pa.) is applied, dried and warmed. Various other useful bonding agents are available such as a Pliobond type (made by the Goodyear Tire and Rubber Company).

Calculations have been made to estimate the stiffness (resistance to bending from top loading) of several conformations of the essentially horizontal wales of this invention and closely-related wales. The results have indicated that the hollow steel wale in the instant invention is significantly stiffer than a solid steel bar wale having the same conformation and cross section as the empty channel of the hollow wale. Thus, a straight 13 gauge hollow wale enclosing a $\frac{3}{4}$ inch hollow square empty interior channel s stiffer than a straight solid $\frac{3}{4}$ inch $\times$ $\frac{3}{4}$ inch cross section by a factor of 1.35. Additionally, the arcuate conformation of most wales here renders them very rigid to horizontal loads.

As shown above, the preferred materials of construction for most of the cover support, i.e., the body and various elements of the body, are of a ferrous metal, e.g., steel and/or cast iron, particularly cast ductile iron. Other metals can be used where their special properties are desirable (and their cost can be tolerated), e.g., stainless steel, high tensile strength steel, wrought iron, bronze, brass, etc. Also suitable in some cases are cover support parts and even much of the main body structure fabricated from glass fiber-, aramid fiber-, or graphite fiber-reenforced resin, e.g., a thermosetting resin such as a thermosetting polyester or epoxy resin or even highly filled polymers including elastomers or ABS plastic and the like, i.e., tough structural polymeric materials.

The tops of the keeper elements of an all-cast durable iron manhole cover support generally are quite stiff and traffic-resistant because they are fairly thick. For lighter weight, and especially for making the lowest initial investment, there has been a great attraction towards the use of the fairly thin, e.g., 12–18 ga., steel keepers having very little outward flanging at the top. The top edge protrudes, if at all, only to about the thickness of a cast iron keeper or perhaps twice that at most.

There are many installations where such economy of investments is the rule. It is not uncommon to find that a significant fraction of the cover supports in those installations are in need of expensive maintenance, repair and/or replacement after a few short years of heavy service.

The inventive cover supports here, with their relatively thin keeper walls, are fairly light for their sizes. However, they are many times stiffer than the light, but unflanged or only slightly-flanged types.

Many modifications and variations of the invention will be apparent to those skilled in the art in the light of the foregoing detailed disclosure. Therefore, it is to be understood that, within the scope of the appended claims, the invention can be practiced otherwise than as shown and described.

I claim:

1. A manhole cover support for emplacing into and raising the effective grade of an existing manhole cover receiving structure that has an upwardly-extending shoulder surface, the cover support comprising a base portion with a seat portion, and a lateral keeper portion that is integral with the base portion, the transverse wall thickness of the keeper portion being substantially less than the corresponding transverse thickness of the base, the outer wall of the base portion facing said shoulder surface, the keeper portion projecting upwardly from the seat, the cover support including a hollow stiffening wale that is integral with and substantially coextensive with the top of the keeper portion.

2. The manhole cover support of claim 1 wherein the wale is substantially rectangular in cross section.

3. The manhole cover support of claim 1 where the wale is at least partially arcuate in cross section.

4. The manhole cover support of claim 1 wherein the wale is interrupted at least once around the upper perimeter of the cover support.

5. The manhole cover support of claim 4 wherein the adjacent ends of the interrupted wale are joined by a tube or a rod or a tang extending from one of the adjacent ends into the other.

6. The manhole cover support of claim 1 wherein the wale contains a loose or settable filler solid.

7. The manhole cover support of claim 1 which has a water seal of compressible polymer interposed between its cover seal and the cover it is to accept, and between its outer perimeter and the upper surface into which it is set and/or the shoulder of the existing manhole cover receiving structure where it sits.

8. The manhole cover support of claim 7 wherein to which at least part of the water seals adhere.

9. The manhole cover support of claim 7 wherein the water seals comprise an elastomer.

10. The manhole cover support of claim 9 wherein the elastomer is foamed.

11. The manhole cover support of claim 1 wherein the hollow wale comprises steel sheet, its walls exterior define a channel, and the wale is at least as stiff as a solid wale of the same kind of steel and whose cross section has the same conformation and dimensions as the channel of the wale.

12. The manhole cover support of claim 1 wherein the base portion defines a hollow channel.

13. The mnahole cover support of claim 1 wherein the base portion and the keeper portion including the wale are of a single piece of structural metal or structural polymeric material.

14. A manhole cover support for emplacing into and raising the effective grade of an existing manhole cover receiving structure that has an upwardly-extending shoulder surface, the cover support comprising a ferrous metal body having a base portion with a seat portion, and a lateral keeper portion that is integral with the base portion and projects upwardly from the seat portion, the transverse wall thickness of the keeper portion being substantially less than the corresponding transverse thickness of the base, the outer wall of the base portion facing said shoulder surface, the support including a hollow stiffening wale that is integral with and substantially coextensive with the top of the keeper portion, the wale being interrupted at least once around the upper perimeter of the cover support, the adjacent ends of the interrupted wale being joined by a tube or a rod or a tang extending from one of the joined adjacent ends into the other.

15. The manhole cover support of claim 14 wherein the wale is substantially rectangular in cross section.

16. The manhole cover support of claim 14 wherein the wale is at least partially arcuate in cross section.

17. The manhole cover support of claim 14 wherein the wale contains a loose or settable filler solid.

18. The manhole cover support of claim 14 which has a water seal comprising compressible polymer interposed between its cover seat portion and the cover it is to accept, and between its outer perimeter and the upper surface into which it is set and/or the shoulder of the existing manhole cover receiving structure where it sits.

19. The manhole cover support of claim 18 to which at least part of the water seals adhere.

20. The manhole cover support of claim 18 wherein the water seals comprise an elastomer.

21. The manhole cover support of claim 9 wherein the elastomer is foamed.

22. The manhole cover support of claim 14 wherein the hollow wall comprises steel sheet, its interior walls define a channel, and the wale is at least as stiff as a solid wale of the same kind of steel whose cross section has the same conformation and cross sectional dimensions as the channel of the wale.

23. The manhole cover support of claim 14 wherein the base portion defines a hollow channel.

24. A manhole cover support for emplacing into and raising the effective grade of an existing manhole cover receiving structure that has an upwardly-extending shoulder surface, the cover support comprising a ferrous metal body having a base portion with a seat portion, and a lateral keeper portion that is integral with the base portion and projects upwardly from the seat portion, the wall thickness of the keeper portion being not substantially in excess of about 0.1 inch, the outer wall of the base portion facing said shoulder surface, the support being characterized by a hollow stiffening wale that is integral with and substantially coextensive with the top of the keeper portion and water seals adherent to the body, the seals comprising elastomer and being interposed between the seat portion and the cover which the support is to accept and between the outer perimeter of the support and the paving material which is to surround it and/or the shoulder of the existing manhole cover receiving structure where it is to sit.

25. The manhole cover support of claim 24 wherein the wale is substantially rectangular in cross section.

26. The manhole cover support of claim 24 wherein the wale is at least partially arcuate in cross section.

27. The manhole cover support of claim 24 wherein the wale is interrupted at least once around the upper perimeter of the cover support.

28. The manhole cover support of claim 27 wherein the adjacent ends of the interrupted wale are joined by a tube or a rod or a tang extending from one of the adjacent ends into the other.

29. The manhole cover support of claim 24 wherein the wale contains a loose or a settable filler solid.

30. The manhole cover support of claim 24 wherein the elastomer is foamed.

31. The manhole cover support of claim 24 wherein the hollow wale comprises a steel sheet, its interior walls define a channel, and the wale is at least as stiff as a solid wale of the same kind of steel and whose cross section has the same conformation and dimensions as the channel of the wale.

32. The manhole cover support of claim 24 wherein the base portion defines a hollow channel.

* * * * *